United States Patent [19]

Niederer

[11] 4,404,719

[45] Sep. 20, 1983

[54] APPARATUS FOR STRIPPING RESIDUAL YARN FROM TEXTILE BOBBINS OR THE LIKE

[75] Inventor: Kurt W. Niederer, Charlotte, N.C.

[73] Assignee: The Terrell Machine Company, Charlotte, N.C.

[21] Appl. No.: 183,388

[22] Filed: Sep. 2, 1980

Related U.S. Application Data

[62] Division of Ser. No. 900,730, Apr. 27, 1978, abandoned.

[51] Int. Cl.[3] ..... B65H 73/00

[52] U.S. Cl. ..... 28/297; 414/298

[58] Field of Search ..... 28/297, 298; 414/224

[56] References Cited

U.S. PATENT DOCUMENTS

| | | | |
|---|---|---|---|
| 869,856 | 10/1907 | Leathers | 28/297 |
| 971,541 | 10/1910 | Koechlin | 28/297 X |
| 1,136,051 | 4/1915 | Ryon | 28/297 |
| 4,097,976 | 7/1978 | Ferguson et al. | 28/297 |

*Primary Examiner*—Robert Mackey

*Attorney, Agent, or Firm*—Richards, Shefte & Pinckney

[57] ABSTRACT

Apparatus for stripping residual yarn from textile bobbins using an oscillating feed drum to feed bobbins singly to a position offset from the stripping position. Two pairs of centering forks transport the fed bobbin to a position in axial alignment with a plunger. Mounted with one pair of the centering forks is a pair of stripping blade support members, each having a pocket and a stripping blade having a plurality of symmetrically disposed stripping surfaces being slidably inserted in the pocket. The plunger is moved axially into engagement with the bobbin forcing it between the stripping blades by means including a drive link pivotally connected at one end to the plunger, a lever arm pivoted at one end about a fixed point spaced from the plunger axis and pivotally connected at its other end to the other end of the drive link, a connecting link pivotally connected at one end to the lever arm intermediate the ends thereof, and a crank arm rotatable about an axis disposed between the plunger axis and the lever arm pivot and pivotally connected at its outer end to the connecting link. The crank arm is rotated through the portion of its path farthest from the lever arm axis during the bobbin stripping stroke to a linearly aligned extension of the crank arm and connecting link, and through the portion of its path closest to the lever arm axis during its return stroke, thereby applying greater force to the plunger during the plunger stripping stroke and obtaining greater speed during the return stroke.

5 Claims, 16 Drawing Figures

FIG. 14
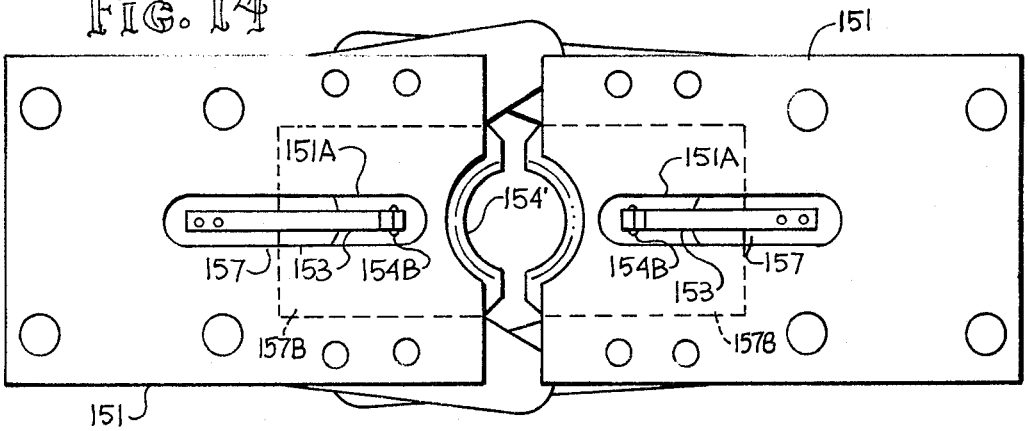
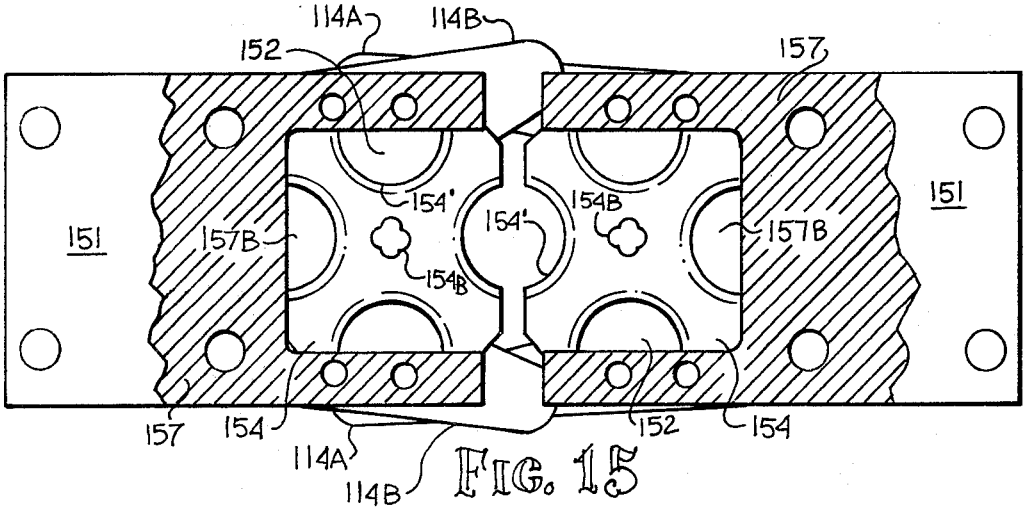
FIG. 15
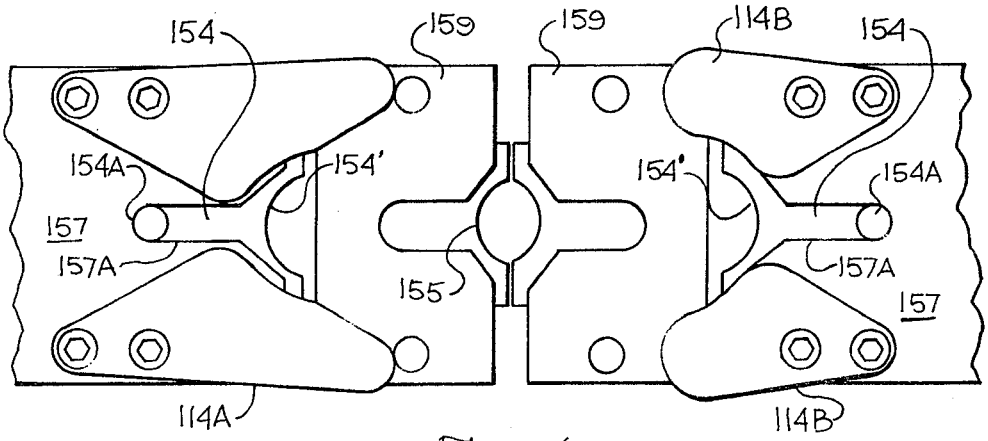
FIG. 16

APPARATUS FOR STRIPPING RESIDUAL YARN FROM TEXTILE BOBBINS OR THE LIKE

CROSS REFERENCE TO OTHER APPLICATION

This is a division of copending U.S. application Ser. No. 900,730, filed Apr. 27, 1978, now abandoned.

BACKGROUND OF THE INVENTION

Numerous textile operations involve the use of yarn taken from various types of yarn packages, such as bobbins or spinning tubes, on which the yarn is wound. Typically, in the continuation of such operations, a bobbin or spinning tube is replaced with a full bobbin or tube before the yarn on the bobbin or tube in use is fully spent. The residual yarn left on the bobbin or tube must then be removed to prepare the spent bobbin or tube for reuse. One of the most common methods of cleaning bobbins for reuse is to strip the residual yarn therefrom axially by forcing the bobbin or tube axially between means for engaging the periphery of the tube. The majority of conventional machines employ cam actuated means for exerting the axial force on the bobbin or tube to be cleaned which is necessary to force the bobbin or tube through the engaging or stripping means. An example of a successful cam actuated machine is depicted and described in Ferguson et al., U.S. Pat. No. 4,097,976, issued July 4, 1978, for "Spinning Tube Stripping Means". While such machines satisfactorily strip the residual yarn from bobbins or tubes, the machines are relatively slow, the Ferguson U.S. Pat. No. 4,097,976 machine being capable of stripping approximately thirty bobbins per minute. Typically, such machines employ a plurality of additional cams to actuate the associated machine motions and, because of this, such machines are relatively large and heavy, and have the additional disadvantage of creating a high noise level.

In contrast, the present invention provides an apparatus employing means for exerting an axial stripping force to the bobbin to be cleaned without the need for an actuating cam. As a result, a significant increase in stripping speed is possible, apparatus embodying the present invention being capable of stripping up to sixty bobbins per minute. When such means are employed to reciprocate a plunger for forcing a bobbin through stripping means, a much longer plunger stroke is possible than with conventional cam actuation of a plunger, thereby eliminating the need for a take-up mechanism to pull the bobbin through the stripping means after the initial thrust of the plunger.

The elimination of the speed restrictions burdening conventional machines also allows the increase of the speed of related machine motions. Therefore, new and novel means for feeding textile bobbins, tubes or the like has been developed to singly deliver bobbins to a position offset from the location of stripping thereby allowing the feeding means to prepare for the feeding of another bobbin while the stripping of the delivered bobbin takes place. New and novel means for supporting and automatically positioning bobbins in a centered position for stripping is also provided, eliminating the need for exactness in the aligning mechanism. Each of these related machine motions is actuated by a single cam. As a net result, the speed of each motion is increased to complement the increased speed of reciprocation of the plunger.

Finally, a new and novel stripping blade mounting assembly is provided wherein each stripping blade has a plurality of symmetrically disposed stripping surfaces and wherein each blade is slidably insertable and removable from the mounting assembly. In contrast to prior machines, no screws or bolts are used to secure the stripping blades in proper disposition for stripping. In this manner, when the exposed stripping blade edges become dulled by use, the blades may easily be removed from the mounting assembly by hand and simply turned to expose another stripping surface or replaced with a new blade, and reinserted in the mounting assembly.

SUMMARY OF THE INVENTION

The present invention provides an apparatus for stripping residual yarn from textile bobbins or the like arranged to feed bobbins from a supply singly to a delivered position, to support and position the bobbin in axial disposition for stripping, to engage the positioned bobbin adjacent one end thereof for stripping, and to engage the other end of the bobbin with a reciprocating plunger axially aligned with the positioned bobbin, forcing the bobbin through means for engaging the positioned bobbin to strip the residual yarn therefrom. Means are provided for reciprocating the plunger which includes a drive link pivotally connected at one end to the plunger, a lever arm pivoted at one end about a fixed pivot axis spaced from the axis of the plunger and pivotally connected at its other end to the other end of the drive link, a connecting link pivotally connected at one end to the lever arm intermediate the ends of the lever arm, and a crank arm mounted for rotation about an axis disposed generally between the plunger axis and the lever arm axis and having an outer end pivotally connected to the other end of said connecting link. Rotation of the crank arm effects a linearly aligned extension of the crank arm and the connecting link forwardly of the crank arm axis, positioning the lever arm and the plunger in a forwardmost position at the end of a bobbin stripping stroke. The crank arm rotates in a direction to move rearwardly through the portion of its circular path closest to the lever arm axis during the return stroke after the connecting link extension and to move forwardly through the portion of its circular path farthest from the lever arm axis during the bobbin stripping stroke whereby relatively greater force is applied to the plunger during the forward bobbin stripping stroke and greater speed is obtained during the rearward return stroke. Thus, high speed cycling is obtained without compromising the stripping force application and the effectiveness of the machine otherwise.

According to another feature of the invention, a feed drum having a peripheral slot for receiving and carrying a bobbin therein is provided for feeding bobbins to the delivered position. Means are provided for oscillating the feed drum from a bobbin receiving position to the delivered position and means are provided for retaining the bobbin within the peripheral slot during the oscillation, the retaining means being movable out of the retaining position when the drum is in the delivered position to permit positioning of the bobbin in axial disposition for stripping, thereby clearing the bobbin from the feed drum so that the feed drum can be returning to the bobbin receiving position while the previously delivered bobbin is being stripped, which results in the bobbin feeding operation accommodating the high speed cycling possible with the aforementioned plunger reciprocating means.

Means are also provided for disengaging the oscillating means when a bobbin is misaligned in the peripheral slot of the feed drum in a manner causing resistance to oscillation thereof by the feed drum, thereby allowing cycling of the machine without binding or damaging of the machine components until the misaligned bobbin is cleared.

According to another feature of the invention, two spaced pairs of centering forks, the forks of each pair being disposed oppositely and transversely of the delivered position and the path of the plunger stroke, are provided for supporting and positioning the bobbin in axial disposition for stripping. Means are provided for moving the forks toward the plunger path, peripherally engaging the bobbin in the delivered position and transporting it to a centered position in axial alignment with the plunger path. This allows the advantageous return of the feed drum during the stripping stroke referred to above.

Finally, a pair of stripping blades having a plurality of symmetrically disposed stripping surfaces are provided, each blade being slidably insertable into holding pockets in the stripping blade supporting members with a selected stripping surface exposed for strippingly engaging bobbins. Thus, after one surface has been used until dull, the blade can be simply and quickly repositioned, and when all surfaces are dull the blade can be simply and quickly replaced with only a short down time.

BRIEF DESCRIPTION OF THE DRAWINGS

FIG. 14 is an enlarged elevational view of the stripping blades disposed in the stripping blade supporting members in bobbin stripping position;

FIG. 15 is a view similar to FIG. 14 broken away to expose the stripping blades in full; and FIG. 16 is a view similar to FIG. 14, but viewed from the opposite side with the stripping blade supporting members opened to expose the secondary stripper blades therebeyond.

DESCRIPTION OF THE PREFERRED EMBODIMENT

Figure 1:
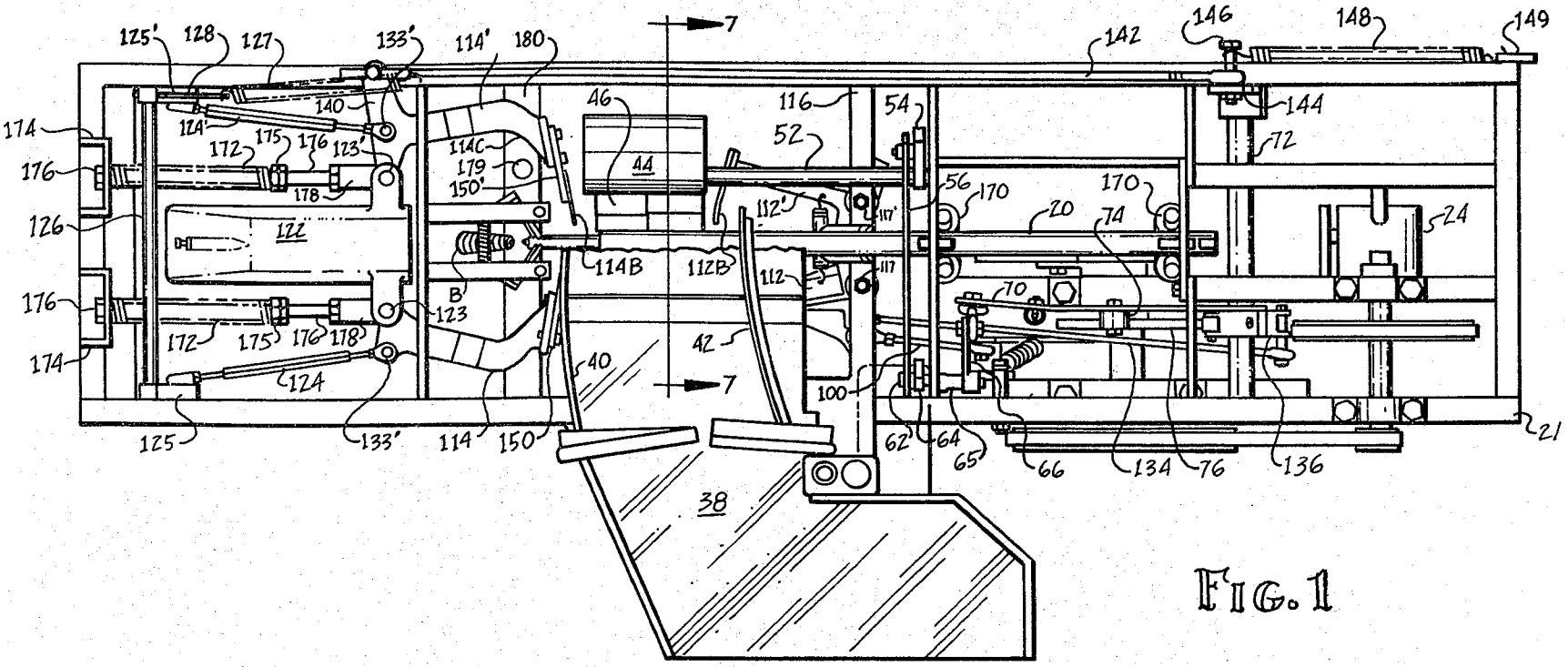
FIG. 1 is an overall plan view of a machine for stripping textile bobbins or the like and in which is incorporated the preferred embodiment of the present invention.
Figure 2:
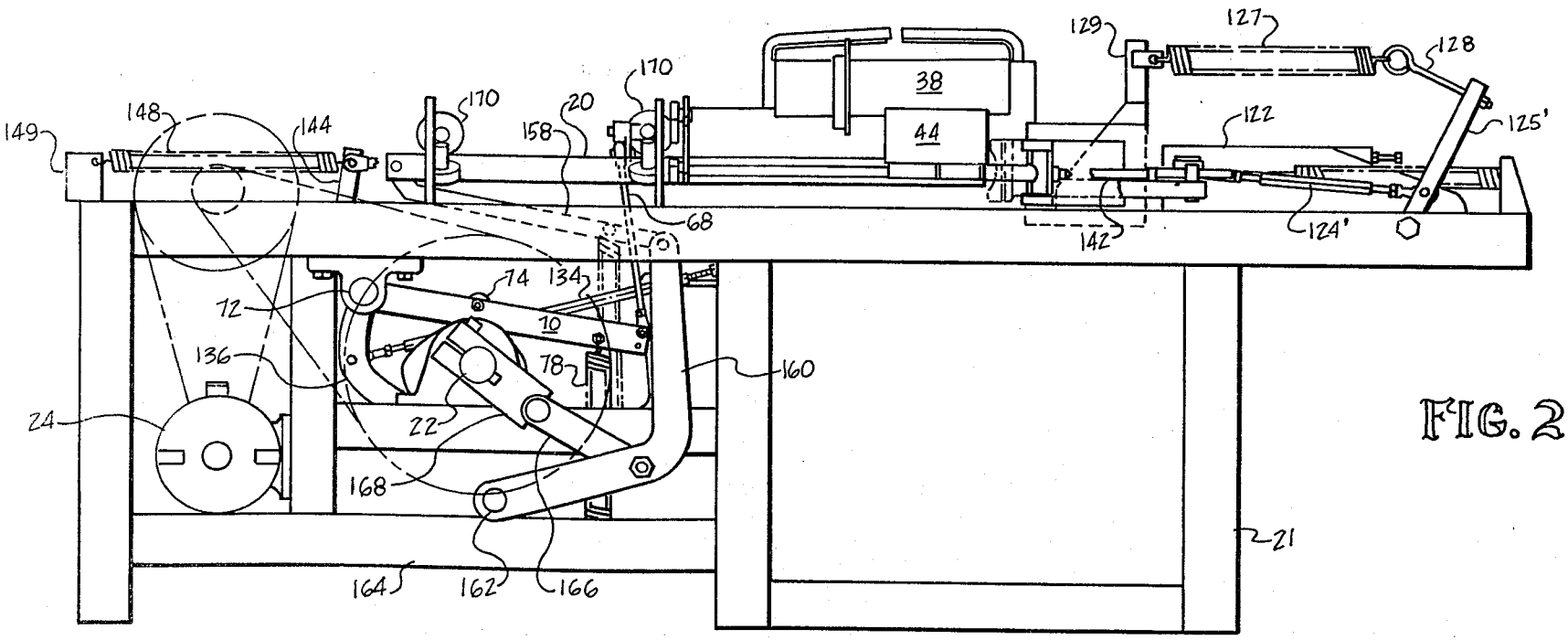
FIG. 2 is a left side elevational view of the machine illustrated in FIG. 1.
Figure 3:
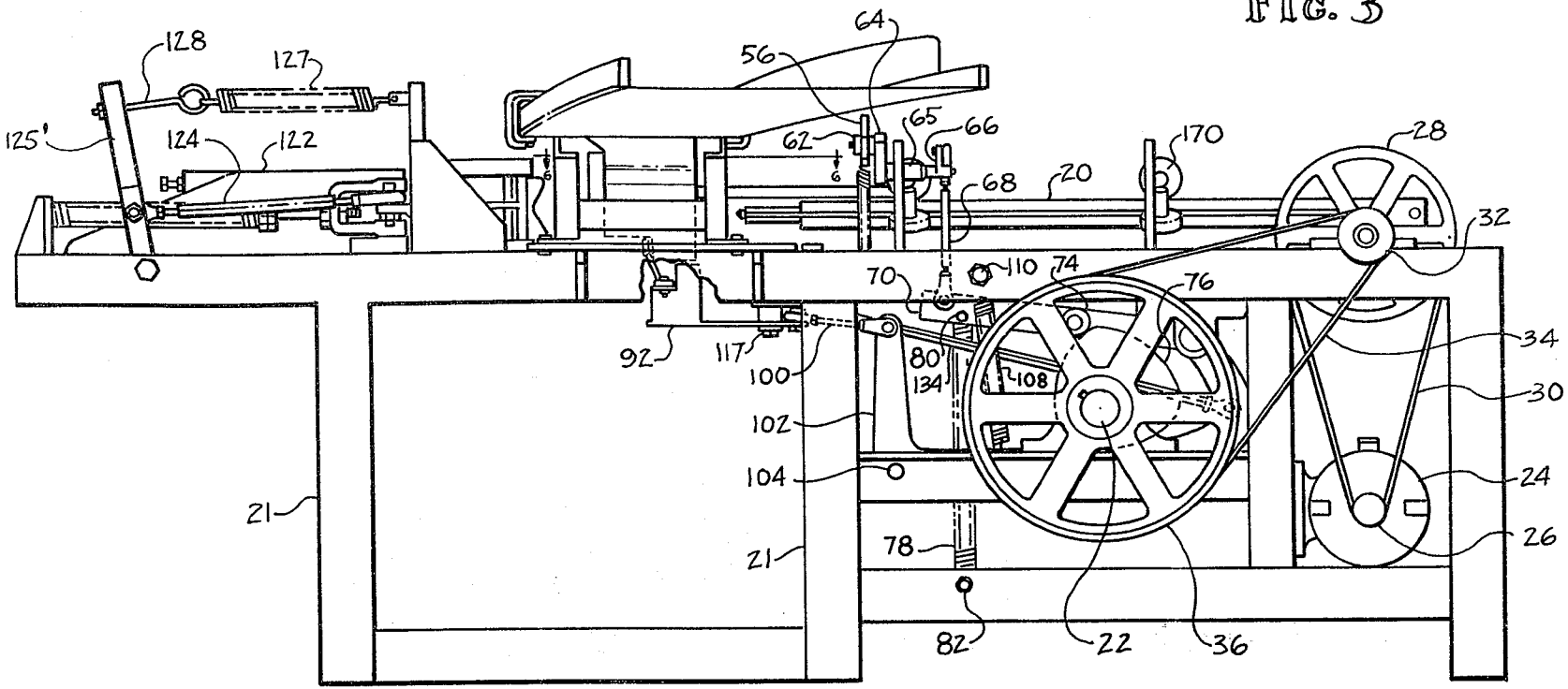
FIG. 3 is a right side elevational view of the machine illustrated in FIG. 1.

Referring now to the accompanying drawings, an apparatus for stripping residual yarn from textile bobbins or the like embodying the present invention is shown generally in FIGS. 1–3, FIGS. 1 and 2 illustrating the apparatus with the plunger 20 in its forwardmost position at the end of a bobbin stripping stroke with a bobbin B, having been stripped, falling into a collection bin (not shown).

Basically, the operation of the apparatus is as follows: bobbins B are fed singly from a supply of bobbins on a supply chute 38 to a delivered position; the delivered bobbin B is supported and positioned in axial alignment with the plunger 20 for stripping; the surface of the positioned bobbin B is strippingly engaged by a pair of stripping blades 154 adjacent the end thereof furthermost from the plunger 20; and the plunger 20, axially aligned with the positioned bobbin, is reciprocated in a linear path to engage the bobbin at its other end, forcing the bobbin through the stripping blades 154 engaging the bobbin to strip residual yarn therefrom. The components employed for performing the various machine motions are arranged on a suitable frame structure, indicated generally by the reference numeral 21, with each of the above described motions originating and being actuated by the rotation of a drive shaft 22. Rotation of the drive shaft 22 is effected by an electric motor 24 which drives a motor shaft 26. Rotation of the motor shaft 26 is transmitted to a main pulley 28 by an endless timing belt 30. Coaxial with the main pulley 28 is a smaller secondary pulley 32, which therefore rotates with the main pulley 28 and drives a drive shaft 22 through another endless timing belt 34 traveling about the secondary pulley 32 and a drive pulley 36, which is coaxial with drive shaft 22.

Figure 7:
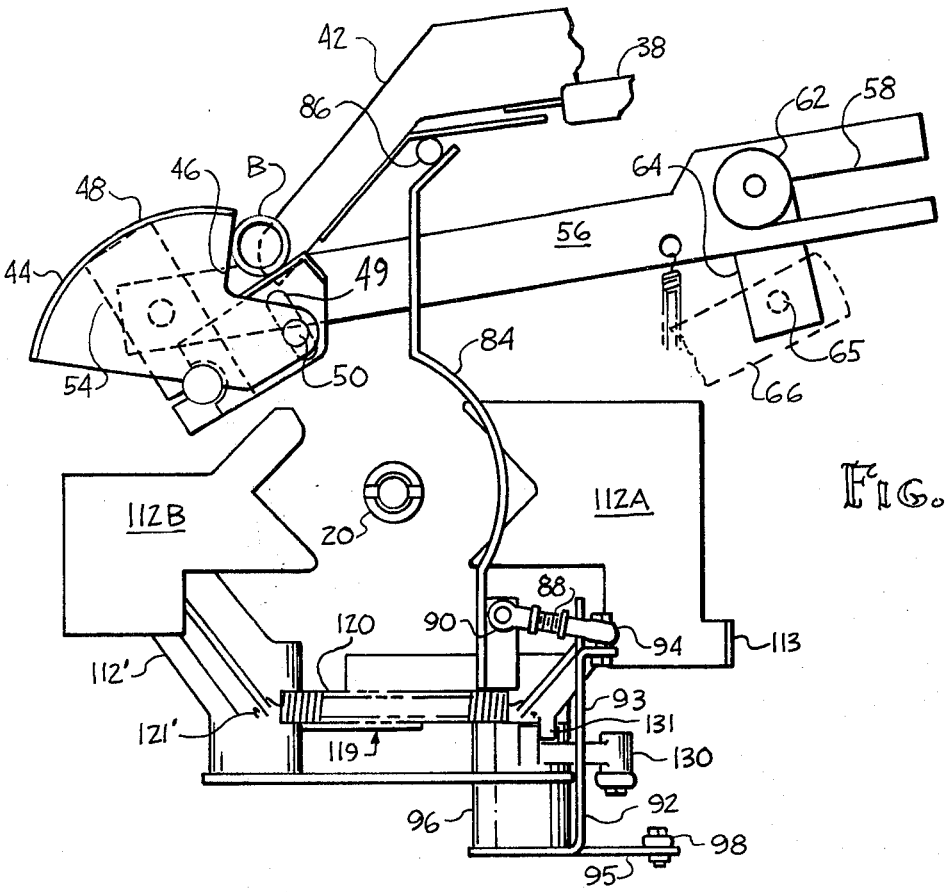
FIGS. 7–11 are enlarged vertical sectional views taken along line 7—7 of FIG. 1, sequentially illustrating the feeding of a bobbin and centering thereof in axial disposition for stripping.
Figure 8:
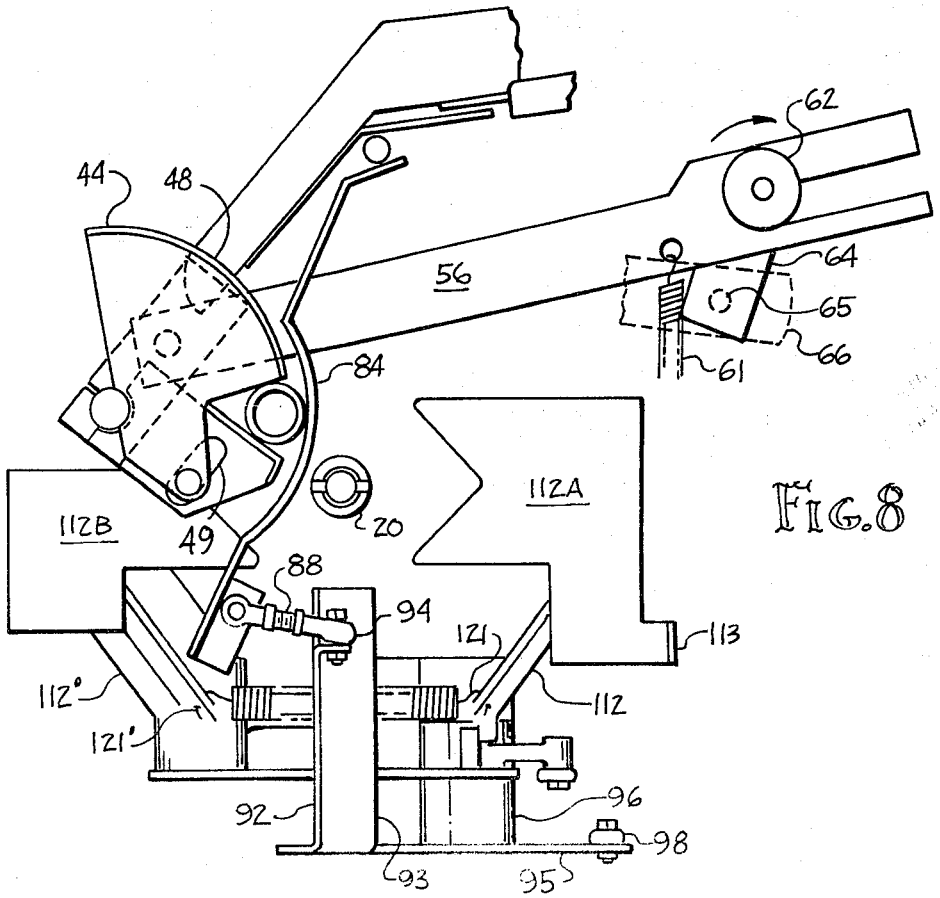
Figure 9:
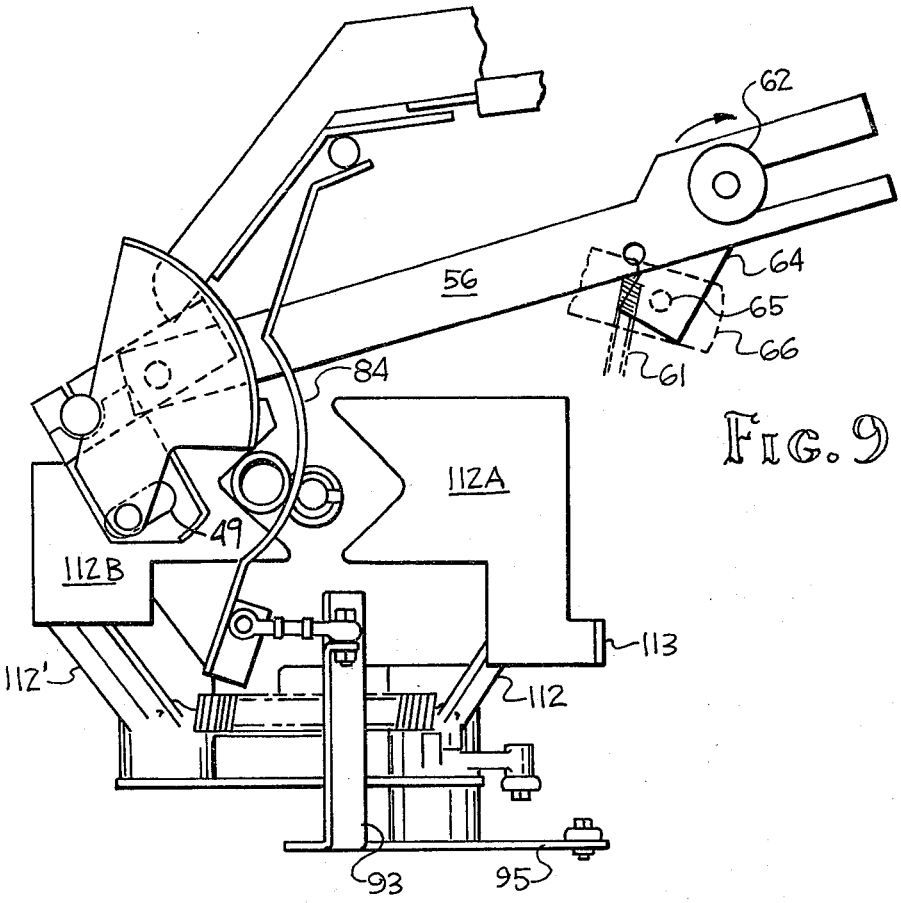
Figure 10:
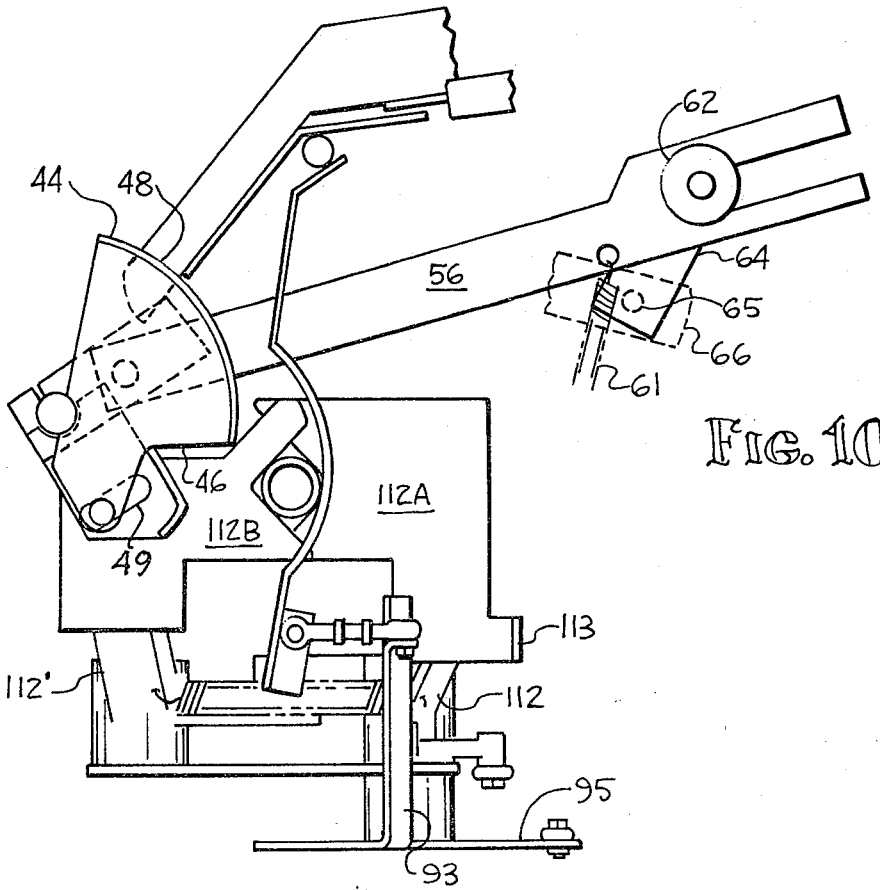

The components employed for performing the aforementioned feeding motion may best be seen in FIGS. 1, 3, and 7–11. Bobbins to be stripped are aligned successively in generally axially parallel relationship on a bobbin supply supporting member, such as the bobbin supply chute 38 shown in FIG. 1, with the bobbin end of largest diameter positioned at the left of the chute as viewed in FIG. 1. Guide rails 40 and 42 are disposed along either side of the supply chute 38 in the direction of bobbin feed to guide the bobbins to the feeding location. The guide rail 42 is adjustably laterally to accommodate bobbins of different lengths. Adjacent the feeding end of the supply chute 38 is a feed drum 44 which has a peripheral slot 46 for receiving and carrying a bobbin therein. The feed drum 44 is positioned for oscillation between a bobbin receiving position, wherein the peripheral slot 46 is immediately adjacent the exit end of the supply chute 38 in position for receiving therein a bobbin from the supply chute 38 (FIG. 7) and a bobbin delivery position, wherein the peripheral slot 46 has moved arcuately downwardly to feed a bobbin carried therein to a delivered position (FIG. 9). As the feed drum 44 oscillates from its bobbin receiving position to its delivered position, the peripheral surface 48 of the feed drum 44 that is in following relation to the slot 46 and is a circular segment centered at the rotational axis of the drum 44 moves to serve as a keeper for the bobbin supply, preventing the next successive bobbin in the supply chute 38 from advancing until the drum 44 returns to the bobbin receiving position. The peripheral slot 46 of the feed drum 44 is adjustable at 50 (FIG. 7) and at corresponding location on the opposite side of feed drum 44 (not shown) to allow for the increasing or decreasing of the size of the peripheral slot 48 to accommodate bobbins of different diameters. This may be done in any conventional manner of providing the arcuate adjustment illustrated, as by providing bolts (illustrated at 50) that connect the components of the feed drum 44, the bolts being adjustably located in a series of holes arcuately arranged or in arcuate slots 49 as illustrated.

Figure 12:
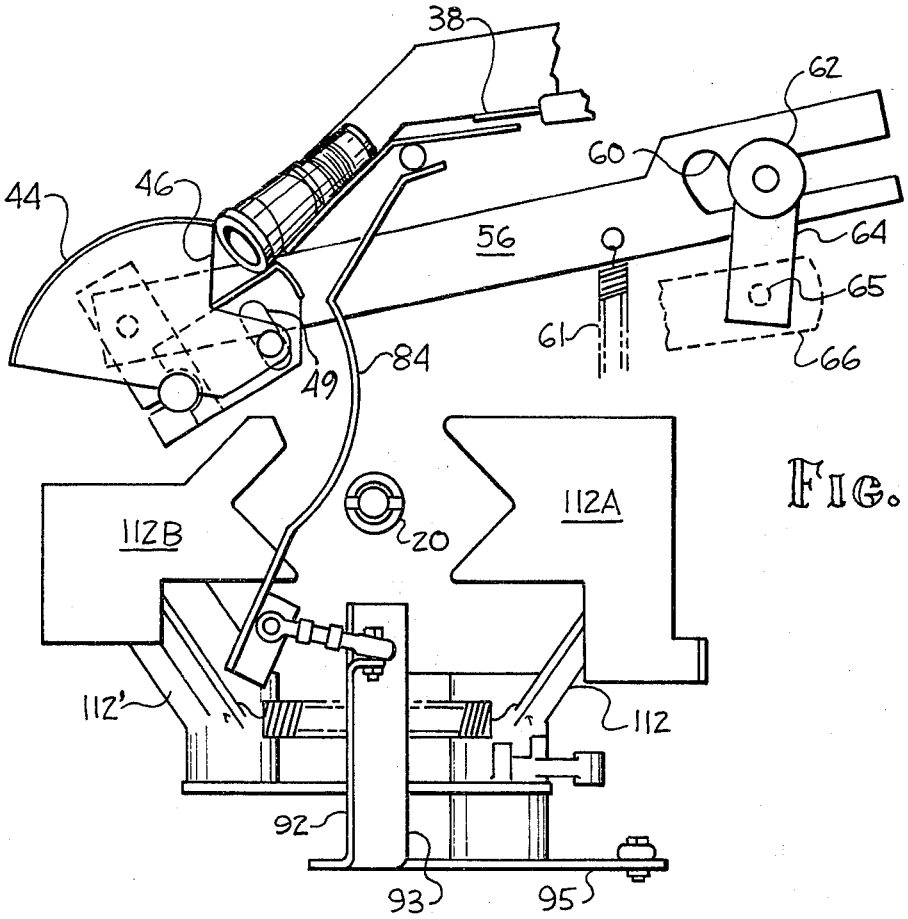
FIG. 12 is an enlarged vertical sectional view similar to FIGS. 7–11, illustrating the means for disengaging the means for oscillating the feed drum.

Feed drum 44 is fixedly attached to one end of a bar 52 disposed generally parallel to the plunger 20 and also parallel to the peripheral slot 48 of the feed drum 44. Bar 52 is fixedly attached at the other end thereof to one end of a link arm 54 which extends in generally perpendicular relationship to the axis of bar 52, the link arm 54 being pivotally attached at its other end to one end of an operating arm 56. A slot 58 is formed in the other end of the operating arm 56, the slot 58 having a drive cam surface 60, upwardly inclined with respect to the remainder of slot 58, as seen in FIG. 12. A spring 61 is attached at one end thereof to operating arm 56 and at the other end thereof to frame 21, thereby biasing the operating arm 56 downwardly. A pin 62, fixedly attached to one end of a link 64, extends horizontally therefrom into slot 58, the downward biasing of operating arm 56 by spring 61 causing the pin 62 to normally ride in slot 58 in driven engagement against the drive cam surface 60. Fixedly attached to the other end of link 64 by a connecting pin 65 is one end of an arm 66. The arm 66 is pivotally connected at its other end to one end of a rod 68, which rod 68 is pivotally connected at its other end to a cam follower arm 70 that is pivotable about a shaft 72 mounted on the frame 21. Attached to the cam follower arm 70 intermediate the two ends thereof is a cam follower 74, which is maintained in engagement with the surface of a cam 76 mounted for rotation about the drive shaft 22, by a spring 78 connected to cam follower arm at 80 and to the lower portion of the frame 21 and 82.

Thus the operation of the feeding motion is as follows. As the electric motor 24 rotates the drive shaft 22, as heretofore described, the cam 76 is rotated, effecting vertical oscillation of the cam follower arm 70 about the shaft 72. Oscillation of cam follower arm 70 in turn effects vertical oscillation of the rod 68 which in turn causes oscillation of the arm 66 about pin 65, thereby causing oscillation of the link 64. Oscillation of link 64 causes the pin 62 to drive against the drive cam surface 60 of the slot 58, thereby effecting reciprocation of the operating arm 56. The reciprocation of the operating arm 56 causes oscillation of the link arm 54 thereby causing rotation of the bar 52 which in turn causes oscillation of the feed drum 44.

FIGS. 7–11 illustrate sequentially one complete cycle of the above-described oscillation of the feed drum.

By virtue of the slot and pin connection between the operating arm 56 and the link 64, means are provided for disengaging the above-described means for oscillating the feed drum 44 whenever a bobbin received from the supply chute 38 is misaligned in the peripheral slot 46 so as not to clear the supply chute 38 upon attempted oscillation of the feed drum 44. As seen in FIG. 12, one end of a bobbin B has been received fully within the peripheral slot 46 of the feed drum 44 while the other end thereof remains partially on the supply chute 38. As the above-described feeding motion is begun by the oscillation of the cam follower arm 70 effected by rotation of the cam 76, the feed drum will begin to oscillate from its bobbin receiving position to its delivered position, but such oscillation will be resisted by jamming of the bobbin B against the supply chute 38. Therefore as pin 62 drives against the drive cam surface 60 of the slot 58 and the reciprocation of operating arm 56 is resisted, the pin 62 will continue to ride against the inclined drive cam surface 60 until the force generated by cam follower arm 70 and effecting oscillation of the pin causes the pin to overcome the biasing force of spring 61 holding pin 62 against the drive cam surface 60 and to move along the inclined drive cam surface 60 to a position out of engagement with the drive cam surface 60, and into the slot 58 as shown in FIG. 12. As the oscillation of link 64 is completed to return it to its original position at the start of the bobbin feeding cycle, pin 62 will again move into engagement in the inclined drive cam surface 60. In this manner, as the link 64 is oscillated by the above-described linkage, the pin 62 carried on the end of link 64 will itself oscillate from a position in engagement against the drive cam surface 60 at the start of the bobbin feeding cycle to a position in slot 58 out of engagement with drive cam surface 60, thereby being free to oscillate without connection to the feed drum 44 and resulting in disengagement of the feed drum drive until the misaligned bobbin is cleared.

In association with the above-described means for oscillating the feed drum 44, means are provided for retaining the bobbin within the peripheral slot 46 during the oscillation of the feed drum 44 from its bobbin receiving position to its delivered position, the retaining means being movable out of the bobbin retaining position when the feed drum 44 reaches its delivered position thereby permitting the subsequent positioning of the bobbin in axial disposition for stripping. For this purpose, a retaining plate 84 is provided, having a curved section shaped to generally conform to the arcuate path of movement of the retained bobbin during the oscillation of the feed drum 44, the retaining plate 84 being connected to a horizontal shaft 86 pivotally mounted on the machine frame 21 adjacent the underside of the bobbin supply chute 38. One end of a rod 88 is attached to the lower portion of cover plate 84 by a ball joint connection 90 while the other end of the rod 88 is attached to an upright member 93 of an arm 92, also by a ball joint connection 94. Arm 92 has a horizontally disposed portion 95 pivotally mounted on stud 96 for horizontal oscillation of arm 92 thereabout. The portion 95 is also pivotally connected at 98 with one end of a rod 100, the rod 100 being pivotally connected at its other end with one end of a cam follower arm 102 (FIG. 3). Cam follower arm 102 is generally L-shaped and is pivotally connected to the frame 21 about an axis 104, generally at the bend in arm 102. Attached to the other end of cam follower arm 102 is a cam follower 106, biased to ride against the surface of the rotating cam 76 by a spring 108 attached to the frame 21 at 110.

Thus the operation of the above-described retaining means is as follows. As the drive shaft 22 and the cam 76 are rotated, the cam follower 106 rides against the surface of cam 76 effecting oscillation of the cam follower arm 102 about its axis 104, thereby causing generally horizontally reciprocation of the rod 100. Reciprocation of the rod 100 causes horizontal oscillation of the arm 92 about the stud 96. The horizontal oscillation of the arm 92 in turn effects reciprocation of rod 88 causing movement of the cover plate 84 into a bobbin retaining position (FIG. 8) while the feed drum oscillates from its bobbin receiving position to its delivered position. Once the feed drum 44 has reached the delivered position and the aforementioned means for supporting and positioning the bobbin in axial stripping disposition has received the bobbin, the means for supporting and positioning the bobbin, hereinafter described in greater detail, begins to move the bobbin from its delivered position in feed drum slot 46 to a position clear of the feed drum 44 in axial alignment with the plunger 20. As the supporting and positioning means moves the bobbin from the delivered position to its centered position, the bobbin in turn moves the retaining plate 84 in the same direction causing the aforementioned linkage which operates the retaining plate 84 to move the cam follower arm 102 against the bias of spring 108 about its axis 104 thereby moving cam follower 106 temporarily out of engagement with the cam 76. Thereafter, rotation of cam 76 will bring the surface thereof into engagement with the outwardly biased follower 106 moving follower 106 further outward against the bias of spring 108 thereby completing the movement of the retaining plate 84 out of its retaining position.

The components employed for performing the aforementioned supporting and positioning of the delivered bobbin in axial disposition for stripping are best seen in FIG. 7. The abovementioned delivered position of the feed drum 44 is offset from the axial disposition of a bobbin centered in the stripping position to allow the feed drum 44 to return to its bobbin receiving position to receive a new bobbin in the peripheral slot 46 thereof while the stripping of the delivered bobbin takes place. Because of this, means is provided for supporting and positioning the delivered bobbin in stripping position, including means for moving the delivered bobbin from the delivered position to a centered position in axial alignment with the plunger 20.

This means for supporting and positioning the delivered bobbin includes two pairs of centering forks, 112A and 112B, and 114A and 114B, carried on the ends of arm members 112 and 112' and 114 and 114', respectively, the two pairs of forks being spaced linearly with respect to the path of the plunger with the forks of each pair being disposed oppositely and transversely to the path of the plunger 20, and to the delivered position of the bobbin, as shown in FIG. 7. Also carried on the ends of arm members 114 and 114' are a pair of opposed stripping blade supporting members 150 and 150' respectively, each of which includes a plate 151 having a slot 151A therein, rigidly affixed to the ends of arm members 114 and 114', and a removable plate 157 rigidly affixed to the plate 151, as can be seen in FIGS. 14–16. Each removable plate 157 has a slot 157A opening outwardly onto one edge of the plate 157 and a recess 157B formed in the plate 157 adjacent the one edge and generally symmetrical about the slot 157A. Thus, when the plate 151 and the removable plate 157 are affixed, a pocket defined by the recess 157B is formed therebetween for holding a stripping blade 154. Each stripping blade 154 has a plurality of symmetrically disposed stripping surfaces 154' of arcuate configuration conforming generally to the curvature of a bobbin to be stripped, the blades 154 preferably being square with a stripping surface 154' on each of the four edges thereof. Each stripping blade 154 has a stud 154A protruding from the center of one side thereof and a relatively small recess 154B formed in the center of the other side thereof. A spring clip 153 is affixed to each removable plate 157 at a location adjacent the recess 157B and extends over and is biased into the recess 157B. A stripping blade 154 may thus be slidably inserted into each holding pocket 152 with a selected stripping surface 154' exposed in bobbin stripping position, the stud 154A sliding into the slot 157A and the spring clip 153 engaging the recess 154B to retain the stripping blade 154 in the pocket 152. It should be noted that, while the stripping blades 154 are preferably square, other configurations are possible, e.g., a rectangular blade having a stripping surface 154' on at least two opposed edges thereof.

Disposed immediately forwardly of stripping blade supporting members 150 and 150' are a pair of secondary stripper blades 155 which perform a second stripping cycle effective to remove any residual yarn not stripped by the stripping blades 154. Secondary stripper blades 155 are fixedly connected to a pair of secondary stripper blade supporting members 159, having a forwardly extending leg 159A and a rearwardly extending leg 159B. Each rearwardly extending leg 159B of secondary stripper blade supporting members 159 is pivotally connected to the frame member 161 at 163 and 163'. A spring 165 is connected at one end thereof to one forwardly extending leg 159A and at the other end thereof to the other forwardly extending leg 159A, thereby biasing the secondary stripper blades 155 slightly rearwardly. As a result of the pivotal connection of supporting members 159 and the biasing force of the spring 165, the secondary stripper blades open and adjust automatically to accommodate passage of a bobbin as it is forced axially between secondary blades 155 by the plunger 20.

Respective arm members 112 and 112' are pivoted on frame member 116 at fixed points 117 and 117' spaced transverse thereon on either side of the path of the plunger 20. Arm members 112 and 112' each have an inwardly extending leg 118 and 118', respectively, which legs 118 and 118' are connected at 119 by a synchronizing pin and slot connection, which connection facilitates synchronized movement of both arm members 112 and 112' about respective pivots 117 and 117' whenever movement of one arm member 112 or 112' occurs.

Extending from the arm member 112 is a stud 131 located intermediately of the pivot 117 and the centering fork 112A carried on the end thereof. Also pivotable about pivot point 117 is a driving member 130 having an edge 132 thereof engagable with the stud 131 to cause outward opening movement of the arm member 112 about its pivot 117 and, by virtue of the synchronous slot and pin connection at 119, outward opening movement of arm member 112' about its pivot 117' away from the path of the plunger 20. A spring 120 extends between arm members 112 and 112' and is attached to arm members 112 and 112' at 121 and 121', respectively, to bias arm members 112 and 112' inwardly toward each other. One end of a rod 134 is attached to driving member 130 at a location thereon outwardly of the pivot 117. The rod 134 is attached at its other end to a cam follower arm 136, fixedly attached to the shaft 72 at one end thereof and having a cam follower 138 attached to the other end thereof. Also fixedly attached to the shaft 72 is an upright bar 144. A bolt 146 extends through the upper end of the bar 144 and is attached to one end of a spring 148, the other end of the spring 148 being connected to an upright frame member 149. In this manner, the spring 148 exerts a rearward force upon the upright bar 144 attached to the shaft 72 thereby also biasing the cam follower 138 of cam follower arm 136 in engagement with the surface of the cam 76.

Respective arm members 114 and 114' are pivotable about fixed points 124 and 123', respectively, on a slide member 122 of the frame 21 and are spaced transversely thereon on either side of the path of the plunger 20. Pivotally attached to arm members 114 and 114' at 133 and 133', respectively, and extending forwardly therefrom are rods 124 and 124', respectively, rods 124 and 124' being pivotally connected at their other ends to upright bars 125 and 125', respectively. Another bar 126 extends between bars 125 and 125', and is fixedly attached to each. A spring 127 is attached at one end thereof to bar 125' by means of a hook 128 and is attached at the other end thereof to upright frame member 129. In this manner, arm members 114 and 114' may be moved inwardly and outwardly as a unit with respect to the path of movement of the plunger 20, and are biased inwardly by the spring 127. Arm member 114' has an outwardly extending leg 140 pivotally connected for horizontal oscillation thereabout near its outermost point with one end of a rod 142 that is pivotally connected at its other end to the bolt 146 extending through the upper end of the upright bar 144, the bar 144 being fixedly attached at its other end to shaft 72 for oscillation therewith.

Figure 6:
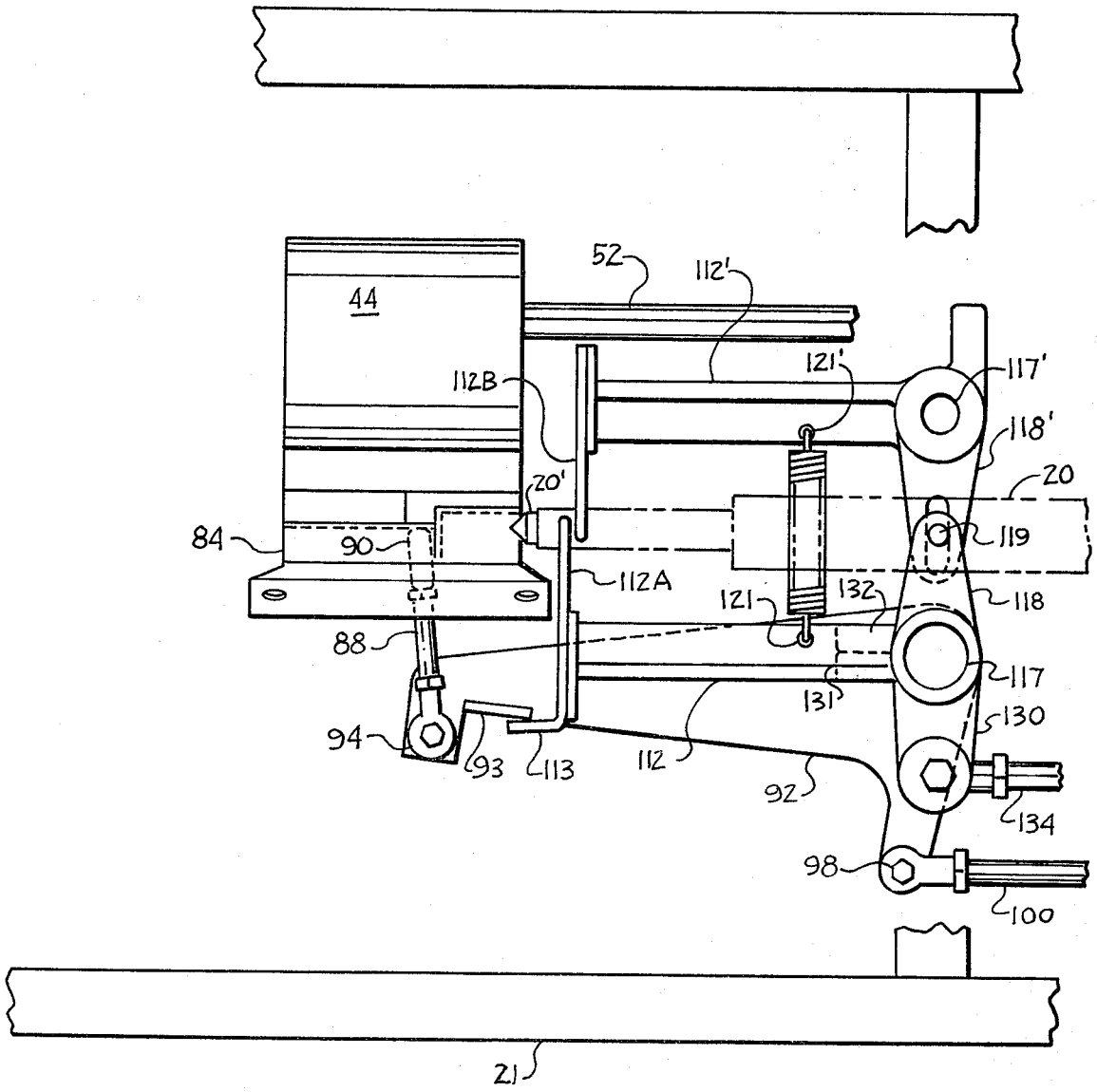
FIG. 6 is a horizontal sectional veiw of the central portion of the machine of FIG. 1 taken along line 6—6 of FIG. 3.
Figure 11:
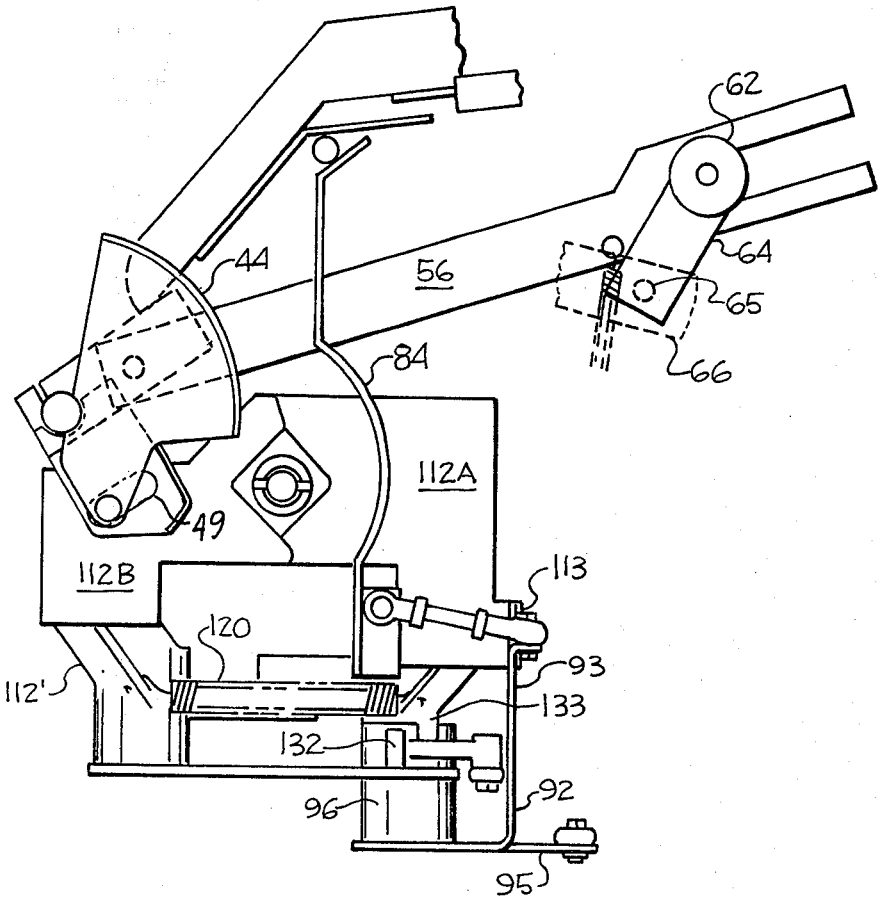
Figure 13:
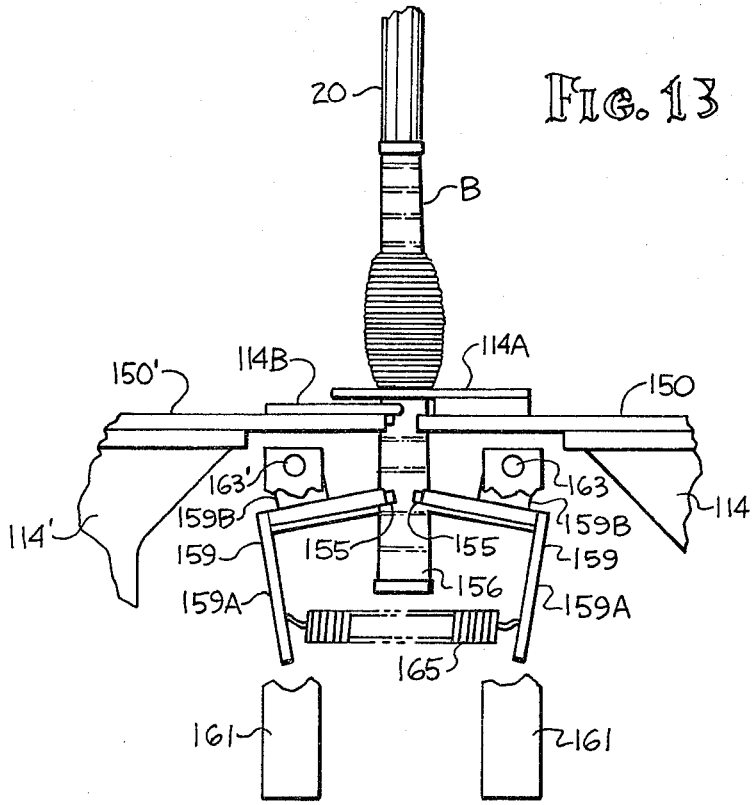
FIG. 13 is an enlarged plan view of the stripping blades, secondary stripper blades and plunger end performing a bobbin stripping operation.

Thus the operation of the above-described supporting and positioning means is as follows. As the drive shaft 22 and the cam 76 carried thereon are rotated, the cam follower 138 rides against the surface of cam 76 effecting synchronous oscillation of cam follower arm 136 and shaft 72, to which cam followed arm 136 is fixedly attached. Oscillation of follower arm 136 and of shaft 72 in unison effects synchronized reciprocation of the rod 134 attached to the follower arm 136 and the rod 142 attached to the shaft 72 by upright bar 144. As viewed in FIG. 6, reciprocation of the rod 134 causes cyclical oscillation of the driving member 130 about its pivot 117, first moving the edge 132 of the driving member in a clockwise direction (FIG. 6) about pivot 117 thereby allowing the spring 120 which biases stud 131 against edge 132 to move the arm members 112 and 112' and centering forks 112A and 112B carried on the ends thereof inwardly with respect to the plunger path, and then moving the edge 132 counterclockwise about pivot 117 thereby driving against the stud 131 and against the biasing force of the spring 120 to open the arm members 112 and 112'. Similarly, reciprocation of the rod 142 causes oscillation of the arm member. 114'about its pivot point 123' thereby also effecting oscillation of the arm member 114 about its pivot point 123 through the above-described connection therebetween. Therefore, as seen in FIGS. 8 and 9, as the feed drum 44 reaches its delivered position, centering forks 112A and 112B, and 114A and 114B, (not shown in FIGS. 7–11) are moved inwardly toward the path of the plunger 20 by the above-described linkage actuated by the cam follower arm 136, forks 112B and 114B peripherally engaging the delivered bobbin carried in the peripheral slot 46 thereof. The retaining plate 84 is moved out of its bobbin retaining position by the inward movement of the bobbin by the centering forks 112B and 114B, as hereinbefore described, allowing the centering forks 112B and 114B to transport the bobbin from the delivered position to a centered position in axial alignment with the plunger path as the centering forks 112A and 112B and 114A and 114B, complete their inward movement (FIG. 10), the retaining plate serving to hold the bobbin within the centering forks 112B and 114B during their inward centering movement. The inward movement of the centering forks 114A and 114B also serves to bring the stripping edges 154' of the stripping blades 154 carried by arm members 114 and 114' into stripping engagement with the surface of the bobbin at the base 156 thereof. The bobbin stripping forward stroke of the plunger 20, hereinafter described in greater detail, then brings the tip 20' of the plunger 20 into engagement with the end of the bobbin held between forks 112 and 112'. As seen in FIG. 11, at this point, retaining plate 84 will be completing its movement out of its bobbin retaining position and will engage the projection 113 of the centering fork 112A, thereby moving arm member 112' outwardly and moving the stud 131 out of engagement with the edge 132 of the driving member 130, the location of the edge 132 inwardly of the stud 131 allowing such movement of the arm member 112 without resistance thereof by the driving member 130. In this manner, a partial opening of centering forks 112A and 112B sufficiently large to allow the plunger 20 to complete its bobbin stripping stroke without engaging either of centering forks 112A and 112B is effected. The plunger 20 thereafter forces the bobbin between the exposed edges 154' of the stripping blades 154 and between the spring biased secondary stripper blades 155 located immediately behind the stripping blades 154 to strip the residual yarn therefrom, as seen in FIG. 13. As the plunger 20 completes its bobbin stripping stroke, the above-described linkage actuated by the cam follower arm 136 causes arm members 112 and 112', and 114 and 114', to open outwardly thereby preventing engagement of the stripping blades by the plunger 20 and preparing for another stripping cycle.

In the event the particular residual yarn being stripped proves to be so tightly wrapped on the bobbin that the pressing force of the plunger 20 is resisted, means are provided to relieve the resisting force by moving the stripping blades outwardly and out of engagement with the base of the bobbin. The slide member 122 is biased rearwardly by springs 172 contained between frame brackets 174 on the frame 21 and nut positioned washers 175 on elongated bolts 176 that extend through the brackets 174 and coaxially through the springs 172 to penetrate clevis elements 178. When the axial stripping force exerted by the plunger 20 is resisted to a sufficient degree, the slide member 122 retracts against the bias of the springs 172 bringing the edge portion 114C of the arm member 114' that slopes outwardly from the mounting of stripping blade support member 150' into contact with a camming roll 179 carried on frame member 180 thereby spreading arm members 114 and 114' enough to relieve the resisting pressure.

Figure 4:
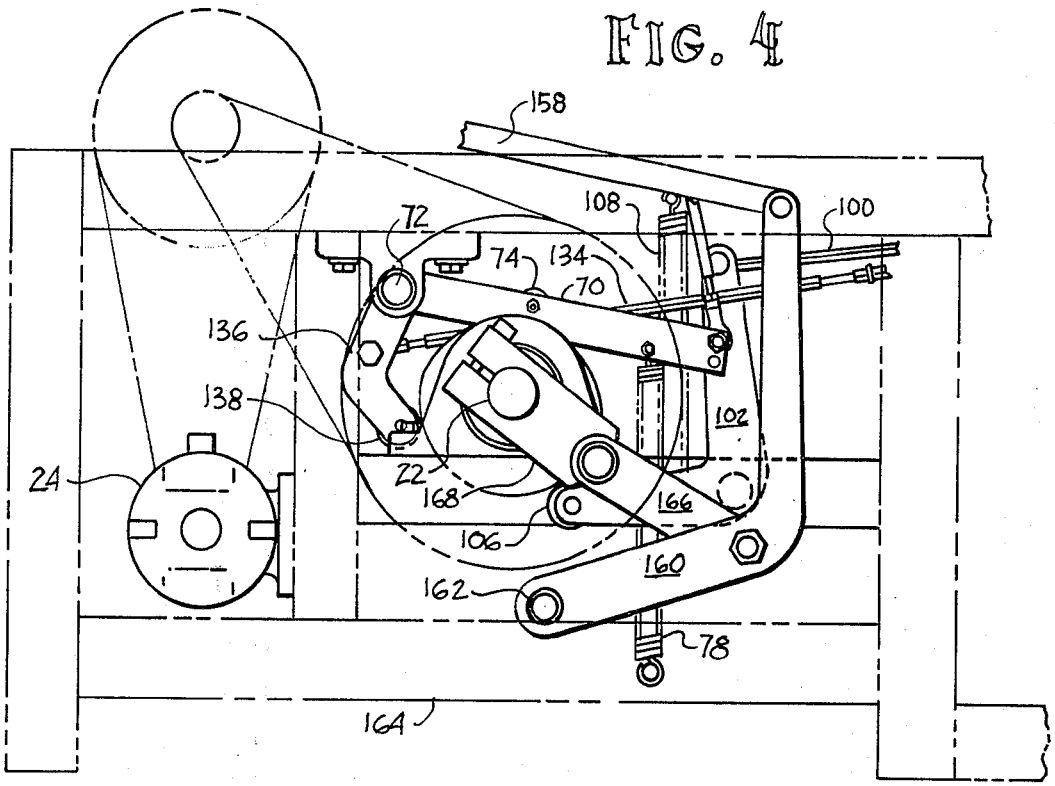
FIG. 4 is an enlarged left side elevational view of the drive assembly of FIG. 2 showing the plunger reciprocation linkage at the completion of a bobbin stripping stroke.
Figure 5:
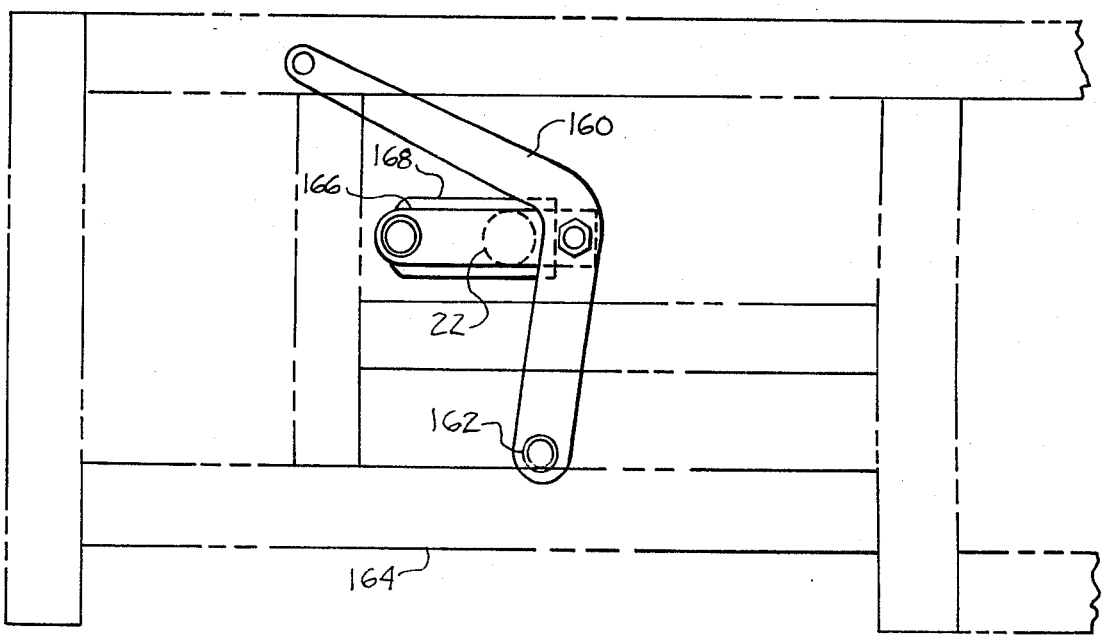
FIG. 5 is a view similar to FIG. 4 showing the plunger reciprocation linkage at the completion of the plunger return stroke.

The components employed for performing the aforementioned reciprocation of the plunger 20 may best be seen in FIGS. 2, 4 and 5. The plunger 20 is carried by two sets of guide rollers 170 for linear reciprocation therethrough between the rearward plunger position illustrated in FIG. 5 and the forward plunger position illustrated in FIG. 4. A drive link 158 is pivotally connected at one end thereof to the rear end of the plunger 20. An L-shaped lever arm 160 is pivoted at one end about a fixed point 162 on a frame member 164 near the bottom of the machine, and is pivotally connected at its other end to the other end of the drive link 158 forwardly of the pivotal connection between the drive link 158 and the plunger 20. A connecting link 166 is pivotally connected at one end thereof to the L-shaped lever arm 160 at a point intermediate the ends of the lever arm 160 generally at the bend therein, and at the other end thereof to the outer end of a crank arm 168, the crank arm 168 being mounted on the drive shaft 22 for rotation therewith.

According to the preferred embodiment, the drive shaft 22 is located between the plunger 20 and the lever arm pivot point 162 and is rotated in a clockwise direction (FIGS. 2, 4 and 5) by the electric motor 24, causing the outer end of the crank arm 168 to travel in a circular path. In this manner, the outer end of the crank arm 168 moves forwardly through the portion of its circular path farthest from the lever arm axis 162 during the bobbin stripping stroke, reaching the position illustrated in FIG. 4 at the end of the bobbin stripping stroke with the plunger 20 in its forwardmost position. This forward movement of the crank arm 168 effects a linearly aligned extension of the crank arm 168 and the connecting link 166, the crank arm 168 and the connecting link 166 being inclined forwardly of the drive shaft 22 and inclined away from the plunger 20 and the lever arm 160 being inclined forwardly from its axis in a direction toward the plunger 20, thereby effecting a forward bobbin stripping plunger stroke. As the outer end of the crank arm 168 continues to move arcuately through the point of linearly aligned extension of the crank arm 168 and connecting link 166, there is a momentary dwell of the plunger in its forwardmost disposition due to the geometrical relation of the crank arm 168 and connecting link 166 at that point. As the crank arm 168 continues to rotate, it moves rearwardly, through the portion of its circular path closest to the lever arm axis 162, passing between the crank arm axis (drive shaft 22) and the lever arm axis 162. FIG. 5 illustrates the disposition of the plunger reciprocating components at the completion of the rearward portion of the circular path of the crank arm 168, the plunger having been fully retracted to its rearwardmost position, and the connecting link 166 substantially overlaying the crank arm 166. Again, there is a momentary dwell as the crank arm 168 continues through the rearward portion of its circular path and enters its forward movement, the dwell resulting from the geometrical relation of the connecting link 168 and crank arm 166 at this point and being of longer duration due to the overlapping relation of the crank arm 166 and connecting link 168 than the dwell at the end of the stripping stroke when the arm and link are linearly aligned in extension. The prolonged dwell at the end of the return stroke is advantageous in providing time for the feeding and centering operations before the plunger engages the next bobbin for stripping, which the dwell provides without qualifying the otherwise fast action of the cycling of the apparatus.

It should be noted that the end of the lever arm 160 pivotally connected to the drive link 158 is spaced substantially the same distance from the axis of the plunger 20 at the end of the return stroke as at the end of the bobbin stripping stroke. Thus it can be seen that the moving force of the lever arm 160 transmitted to the plunger 20 is generally linear, and that therefore most of the force generated by the crank arm is transmitted to effect the linear reciprocation of the plunger, thereby increasing the efficiency of the system.

With the aforementioned rotation of the crank arm 168 to pass closest to the lever arm pivot axis 162 during the return stroke and farthest therefrom during the stripping stroke, the length of the theoretical lever acting on the lever arm 160 is relatively short during the return stroke so that an increment of movement of the continuously rotating crank arm 168 will produce a substantially greater increment of movement of the lever arm than when the crank arm passes farthest from the lever arm axis 162 during the stripping stroke, but during the latter, a greater force is being applied by the longer theoretical lever length acting on the lever arm 160. In this manner, clockwise rotation of the crank arm 168 transmits a greater force to the plunger 20 during its forward bobbin stripping stroke while achieving greater speed of movement of the plunger 20 during the return stroke.

The operation of the above-described bobbin stripping apparatus may be summarized as follows. With the feed drum 44 in its bobbin receiving position, a bobbin having residual yarn thereon is fed from the bobbin supply chute 38 and received in the peripheral slot 46 of the feed drum 44. By means hereinbefore described, feed drum 44 is then oscillated from its bobbin receiving position to a delivered position offset from the path of the plunger 20. As the feed drum begins to move from the bobbin receiving position, the retaining plate 84 is moved, by means hereinbefore described, into position to retain the bobbin in the peripheral slot 46 of the feed drum 44. When the feed drum 44 reaches the delivered position, arm members 112, 112', 114 and 114', begin to move inwardly toward the plunger path, bringing centering forks 112B and 114B into engagement with the bobbin carried in the peripheral slot 46. Arm members 112, 112', 114 and 114' continue to move inwardly toward the plunger path, transporting the bobbin from the delivered position, centering it in a centered position in axial alignment with the plunger 20, and bringing the stripping blades 154 and 154' carried by the stripping blade supporting members 150 and 150' respectively, on the ends of the arm members 114 and 114', respectively, into stripping engagement with the surface of the bobbin about the base thereof. As this occurs, retaining plate 84 is moved out of its bobbin retaining position by the inward movement of the bobbin by the centering forks 112B and 114B, the retaining plate 84 serving to hold the bobbin within the centering forks 112B and 114B during their inward centering movement. During this time, the feed drum 44 begins its return to the bobbin receiving position by the means hereinbefore described. At the same time the plunger 20 has completed its dwell at the end of the preceding return stroke and begins its forward bobbin stripping stroke, engaging the end of the bobbin held within the centering forks 112A and 112B. At this point, the retaining plate 84 is completing its movement out of bobbin retaining position and engages the projection 113 of the centering fork 112A causing a partial opening of centering forks 112A and 112B sufficiently large to allow the plunger 20 to pass therethrough and complete its bobbin stripping stroke without engaging either of centering forks 112A and 112B. The plunger 20 thereafter completes its bobbin stripping stroke, forcing the bobbin axially between the exposed edges 154' of the stripping blades 154 and between the secondary stripping blades 155. As the plunger 20 completes its bobbin stripping stroke, the arm members 112 and 112' 114 and 114' are moved outwardly from the path of the plunger 20 and returned to their original position opposite and transverse the plunger path. The stripping of the bobbin having been completed, the plunger 20 returns rapidly to its rearwardmost position as the feed drum 44 begins a feeding rotation and a new stripping cycle is begun.

Although the present invention has been described in relation to the preferred embodiments, it is to be understood that modifications and variations may be resorted to without departing from the substance or scope of the present invention as those skilled in the art will readily understand. Such modification and variations are within the scope of the present invention, which is intended to be limited only by the appended claims and equivalents thereof.

I claim:

1. In an apparatus for stripping residual yarn from textile bobbins or the like, said apparatus being of the type having means for engaging a textile bobbin having residual yarn thereon at a delivered position of the bobbin and stripping said residual yarn therefrom including means for supporting and positioning the bobbin in disposition for stripping, an improved means for feeding textile bobbins to said engaging and stripping means comprising (1) a bobbin supply supporting member supporting thereon a plurality of textile bobbins having residual yarn thereon, (2) a feed drum having a peripheral slot for receiving and carrying a bobbin therein, disposed for oscillation between a bobbin receiving position wherein said peripheral slot of said feed drum is adjacent said bobbin supply supporting member and a bobbin delivering position wherein said peripheral slot is adjacent said engaging and stripping means at said delivered position, (3) an operating arm linked to said feed drum in a manner such that reciprocation of said operating arm in a bobbin feeding stroke effects oscillation of said feed drum from said bobbin receiving position to said bobbin delivering position, and (4) means for reciprocating said operating arm and connected thereto by a pin and slot connection including means for disengaging the operating arm reciprocation of said feed drum when a bobbin is misaligned in said peripheral slot so as to engage said supply supporting member and cause resistance to oscillation thereof by said feed drum, said disengaging means having a drive cam surface in said slot engagable with said pin for driving said operating arm in said bobbin feeding stroke to effect oscillation of said drum, said cam surface being inclined to permit said pin to move in said slot to a position out of engagement with said cam surface when said bobbin is misaligned to resist feed drum oscillation.

2. In an apparatus for stripping residual yarn from textile bobbins or the like, said apparatus being of the type having means for engaging a textile bobbin having residual yarn thereon at a delivered position of the bobbin and stripping said residual yarn therefrom including means for supporting and positioning said bobbin in disposition for stripping, an improved means for feeding textile bobbins to said engaging and stripping means comprising (1) a bobbin supply supporting member supporting thereon a plurality of textile bobbins having residual yarn thereon, (2) a feed drum having a peripheral slot for receiving and carrying a bobbin therein, disposed for oscillation between a bobbin receiving position wherein said peripheral slot of said feed drum is adjacent said bobbin supply supporting member and a bobbin delivering position wherein said peripheral slot is adjacent said engaging and stripping means at said delivered position, (3) an operating arm linked to said feed drum in a manner such that reciprocation of said operating arm in a bobbin feeding stroke effects oscillation of said feed drum from said bobbin receiving position to said bobbin delivering position, (4) means for reciprocating said operating arm and connected thereto by a pin and slot connection including means for disengaging the operating arm reciprocation of said feed drum when a bobbin is misaligned in said peripheral slot so as to engage said supply supporting member and cause resistance to oscillation thereof by said feed drum, said disengaging means having a drive cam surface in said slot engagable with said pin for driving said operating arm in said bobbin feeding stroke to effect oscillation of said drum, said cam surface being inclined to permit said pin to move in said slot to a position out of engagement with said cam surface when said bobbin is misaligned to resist feed drum oscillation, and (5) means for retaining said bobbin within said peripheral slot during oscillating of said drum from said bobbin receiving position to said bobbin delivering position and movable out of bobbin retaining position when said drum is in said bobbin delivering position.

3. In an apparatus for stripping residual yarn from textile bobbins or the like, the improvement of claim 2 and characterized further in that said retaining means includes a plate having a curved section shaped to generally conform to the path of movement of said retained bobbin during said oscillation of said drum from said bobbin receiving position to said bobbin delivering position.

4. In an apparatus for stripping residual yarn from textile bobbin or the like, the improvement of claim 2 and characterized further in that said supporting and positioning means includes means for moving said bobbin from said delivered position to a centered position in disposition for stripping.

5. In an apparatus for stripping residual yarn from textile bobbins or the like, the improvement of claim 4 and characterized further in that said delivered position of said bobbin is offset from said centered position, in that said supporting and positioning means includes two spaced pairs of centering forks, the forks of each pair being disposed oppositely and transversely to said centered position and to said delivered position of said bobbin, and by means for moving said forks toward said centered position, peripherally engaging said bobbin in said delivered position and transporting said bobbin from said delivered position to said centered position in disposition for stripping.

* * * * *

UNITED STATES PATENT OFFICE

CERTIFICATE OF CORRECTION

Patent No. 4,404,719 Dated September 20, 1983

Inventor(s) Kurt W. Niederer

It is certified that error appears in the above-identified patent and that said Letters Patent are hereby corrected as shown below:

Column 3, line 49, delete "veiw" and insert therefor --view-- .

Column 4, Line 50, delete "adjustably" and insert therefor --adjustable-- .

Column 5, line 42, delete "and" and insert therefor --at-- .

Column 9, line 6, delete "124" and insert therefor --123-- .

Signed and Sealed this

*Seventh* Day of *January 1986*

[SEAL]

*Attest:*

DONALD J. QUIGG

*Attesting Officer*

*Commissioner of Patents and Trademarks*